United States Patent [19]

Kromer et al.

[11] Patent Number: 4,997,661

[45] Date of Patent: Mar. 5, 1991

[54] FLEXIBLE, INTERNALLY PRESSURIZABLE PACKAGE, METHOD OF USING SAME AND LIQUID PRODUCT PACKAGED THEREIN

[75] Inventors: Horst Kromer; Rolf Mueller; Walter H. Alban; Klaus-Juergen Hiltmann, all of Wiesbaden, Fed. Rep. of Germany

[73] Assignee: Hoechst Aktiengesellschaft, Frankfurt am Main, Fed. Rep. of Germany

[21] Appl. No.: 865,827

[22] Filed: May 22, 1986

Related U.S. Application Data

[63] Continuation of Ser. No. 579,456, Feb. 13, 1984, abandoned.

[30] Foreign Application Priority Data

Feb. 15, 1983 [DE] Fed. Rep. of Germany ..... 3305144

[51] Int. Cl.[5] ..... B65B 3/04; B65D 3/04; B65D 3/12; B65D 8/22

[52] U.S. Cl. ..... 426/126; 53/449; 53/452; 53/478; 156/69; 206/525; 220/450; 220/613; 220/616; 220/643; 229/3.5 MF; 229/4.5; 229/5.5; 383/80; 383/104; 383/113; 383/121; 426/398

[58] Field of Search ..... 220/66, 67, 319, 450, 220/613, 616, 643; 229/5.5, 4.5, 5.7, 3.5 MF; 383/78, 80, 104, 113, 121; 426/106, 118, 126, 127, 398, 124, 410, 126, 398; 156/69; 206/525, 525; 53/149, 452, 478

[56] References Cited

U.S. PATENT DOCUMENTS

| | | | |
|---|---|---|---|
| 2,348,696 | 5/1944 | Schabacker | 156/69 |
| 2,739,917 | 3/1956 | Schulze | 156/305 |
| 2,802,593 | 8/1957 | Slaughter | 156/69 |
| 2,982,457 | 5/1961 | D'Alelio | 229/3.5 MF |
| 3,098,582 | 7/1963 | Martin | 220/67 |
| 3,276,616 | 10/1966 | Lurie | 220/276 |
| 3,317,110 | 5/1967 | Palmer | 229/5.5 |
| 3,381,818 | 5/1968 | Cope et al. | 229/3.5 MF X |
| 3,394,871 | 7/1968 | Williams et al. | 383/78 X |
| 3,583,624 | 6/1971 | Peacock | 229/5.5 |
| 3,620,774 | 11/1971 | Ford et al. | 426/106 |
| 3,799,423 | 3/1974 | Cvacho | 220/450 |
| 4,009,287 | 2/1977 | Clarke | 426/106 |
| 4,096,309 | 6/1978 | Stillman | 426/126 X |
| 4,209,126 | 6/1980 | Elias | 229/5.7 X |
| 4,252,585 | 2/1981 | Raabe et al. | 229/5.5 X |
| 4,262,819 | 4/1981 | Hayes | 229/5.5 X |
| 4,454,979 | 6/1984 | Ikeda et al. | 383/104 X |

FOREIGN PATENT DOCUMENTS

| | | | |
|---|---|---|---|
| 732941 | 4/1966 | Canada . | |
| 751487 | 9/1933 | France | 229/5.7 |
| 1475908 | 4/1967 | France . | |
| 2038387 | 1/1971 | France . | |
| 536225 | 5/1941 | United Kingdom . | |
| 1572399 | 7/1980 | United Kingdom . | |
| 1572400 | 7/1980 | United Kingdom . | |
| 8002544 | 11/1980 | World Int. Prop. O. | 229/5.5 |

*Primary Examiner*—Allan N. Shoap

*Attorney, Agent, or Firm*—Foley & Lardner, Schwartz, Jeffery, Schwaab, Mack, Blumenthal & Evans

[57] ABSTRACT

Disclosed is a flexible package made of plastic and capable of standing by itself, comprising a generally cylindrically-shaped body, comprised of a flexible plastic film; a first cover part at one end of the cylindrically-shaped body; and a second cover part at the opposite end of the cylindrically-shaped body, wherein the cover parts are bonded to the plastic film by heat-sealing. Also disclosed is a packaged liquid product, in particular a product under gas pressure, and a method for producing the packaged product.

19 Claims, 2 Drawing Sheets

FLEXIBLE, INTERNALLY PRESSURIZABLE PACKAGE, METHOD OF USING SAME AND LIQUID PRODUCT PACKAGED THEREIN

This is a continuation of application Ser. No. 579,456, filed Feb. 13, 1984, now abandoned.

BACKGROUND OF THE INVENTION

The present invention relates to a flexible package which can be pressurized and is suitable for products to be packaged which are under internal pressure, in particular liquids. The invention also relates to a process for the production of the package, and to its use for packaging products, such as liquids.

Products to be packaged, and in particular liquids which contain pressurizing gases, such as carbonated mineral water or fruit juice, have so far been filled in metal cans or bottles exclusively. It is a disadvantage of these forms of packaging that they are very voluminous, and for this reason their disposal accordingly causes serious environmental problems.

Flexible packages for so-called "still" liquids, i.e., liquids which are not pressurized, are known, for example, from German Pat. No 12 81 140 and No. 13 03 917. The advantage which these flexible packages possess over the above-mentioned cans or bottles is that they can be easily folded after removal of the liquids and thus be disposed of in an environmentally beneficial way. It is, however, a disadvantage of these sealed flexible packages that their seams are cleaved when they are filled with liquids under gas pressure, so that the liquids leak through.

SUMMARY OF THE INVENTION

It is therefore an object of the present invention to provide an improved flexible package or container.

It is a particular object of the invention to provide a flexible package which contains all the layers which are necessary to protect the material to be packaged.

Another object of the invention is to provide such a package which is capable of standing upright.

Still another object of the invention resides in providing a flexible package in which the internal pressure exerted by the contents, preferably a liquid, does not lead to a cleavage of the sealed seams and which after removal of the filling can be easily compressed by hand, to a size which is considerably smaller than that of the original volume.

It is also an object of the invention to provide a method for producing a filled package utilizing the improved package according to the invention.

Another object of the invention is to provide a packaged product, preferably a pressurized liquid, using the package according to the invention.

In accomplishing the foregoing objects, there has been provided in accordance with one aspect of the present invention a flexible package which can be pressurized and is suitable for internally pressurized products to be packed, and which is made of plastic and capable of standing by itself, comprising a generally cylindrically-shaped body, comprised of a flexible plastic film; a first cover part at one end of said cylindrically-shaped body; and a second cover part at the opposite end of said cylindrically-shaped body; said cover parts being bonded to said plastic film by sealing in such a way that the internal pressure exerted by the contents, preferably a liquid, does not lead to a cleavage of sealed seams. The term "cleavage" means that the force of the pressure acting upon the sealed seams does not act at a right angle, but at an angle of 180° so that it is rather a tangential, i.e. shearing force. The shearing strength of the sealed seams is greater than the resistance to cleavage. In one embodiment, the cylindrically-shaped body comprises a seamless tubular film, whereas in another embodiment the cylindrically-shaped body comprises a film which includes a sealable material on each face and comprises a sealed, overlapped longitudinal seam. The cover parts may comprise either injection-molded pieces of plastic which can be sealed to the cylindrically-shaped body, or plastic films which can be sealed to the cylindrically-shaped body. In one preferred embodiment, at least the cylindrically-shaped body comprises a sealable multiple layer film, and preferably the cover parts are made of the same material.

According to another aspect of the invention there is provided a method for the production of a filled package of the type described above, comprising the steps of first forming a cylindrically-shaped body of a flexible film; sealing one cover part to the cylindrically-shaped body by forming an external or internal seam, to form an open container; subsequently filling a material to be packaged into the open container; and finally sealing the second cover part to the cylindrically-shaped body.

Also provided according to the invention is a packaged liquid product, comprising a package as defined above, containing a liquid product under gas pressure, preferably a carbonated liquid.

Further objects, features and advantages of the invention will become apparent from the detailed description of preferred embodiments which follows, when considered together with the attached figures of drawing.

DETAILED DESCRIPTION OF PREFERRED EMBODIMENTS

The cylindrically-shaped, flexible body of the package according to the invention can be comprised of a sealable seamless tubular film or have a sealed overlapped seam. The latter embodiment is chosen in all cases where the cylindrically-shaped body is made of a composite film which contains one or more metal layers, preferably layers of aluminum foil. Furthermore, the cylindrically-shaped body can be made of a sealable monofilm or of a composite film, it being possible for the latter, inter alia, to be produced by coextrusion as a flat or tubular film.

If composite films which contain metal layers are used, the clyindrical body is made of films which have been produced by means of melt film coating or laminating.

The applied sealable layers are commonly known and are preferably made of polyethylene, copolymers of polyethylene or ethylene/vinyl acetate copolymers.

The type of film, i.e., monofilm or composite film, used for the production of the cylindrically-shaped body depends on the respective material to be packaged. The films which can be employed are known in the art and, therefore, need not be explained in detail.

Depending on the permeability to gas of the films, it has been found advantageous to provide gas barrier layers. If the material to be packaged is sensitive to light, i.e., if it changes color or even decomposes under the action of light, composite films which contain light impermeable layers, especially metal layers are preferably used. Composite films of this type also guarantee good impermeability to gas. As mentioned above, cylindrically-shaped bodies produced of this type of film preferably possess an overlapped seam.

At the ends of the cylindrically-shaped body, covers are provided which are bonded to the cylindrically-shaped body by sealing. The covers are comprised of injection-molded pieces and/or flexible films.

It is thereby possible for the cover part forming the top of the container to be comprised of an injection-molded piece and for the other cover part to be comprised of a film. Preferably, both cover parts are made of films, however, since in this case the package can be particularly easily compressed by hand after removal of the contents. If it is appropriate, in view of the material to be packaged, to use a composite film for producing the package, the cover parts are advantageously made of the same composite film.

If the cylindrically-shaped body contains one or more metal layers, it is preferred that the cover parts also contain one or more metal layers. In one embodiment, one of the cover parts can, for example, be sealed to the cylindrically-shaped body from the outside, in a way such that it surrounds the rim of the cylindrically-shaped body. This embodiment is preferred when the cover part is made of film material, since a support pressure can be exerted from the interior of the cylindrically-shaped tubular body during sealing.

Figure 2:
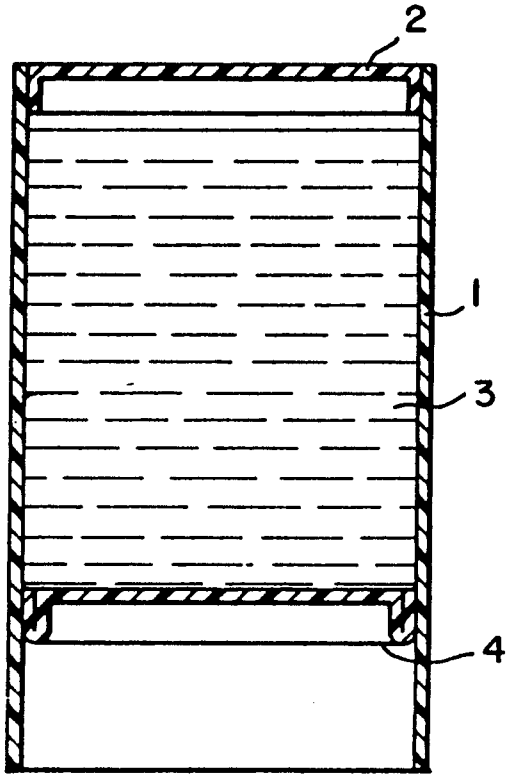
FIG. 2 is a sectional view of a filled package according to an alternate embodiment of the invention.

Special preference is given to an embodiment in which the cover part forming the top end of the package is sealed to the cylindrically-shaped body from the outside in such a way that it surrounds the rim of the cylindrically-shaped body, while the cover part forming the bottom of the package is sealed to the cylindrically-shaped body from the inside, i.e., on the inside circumference. For this purpose, films are preferably used, which are provided with a sealable layer on one side only. The edges of the films are turned over or inverted into the shape of a double-walled trough and sealed from the inside on the cylindrically-shaped body over the length of the double wall, as shown in FIG. 2.

Figure 3:
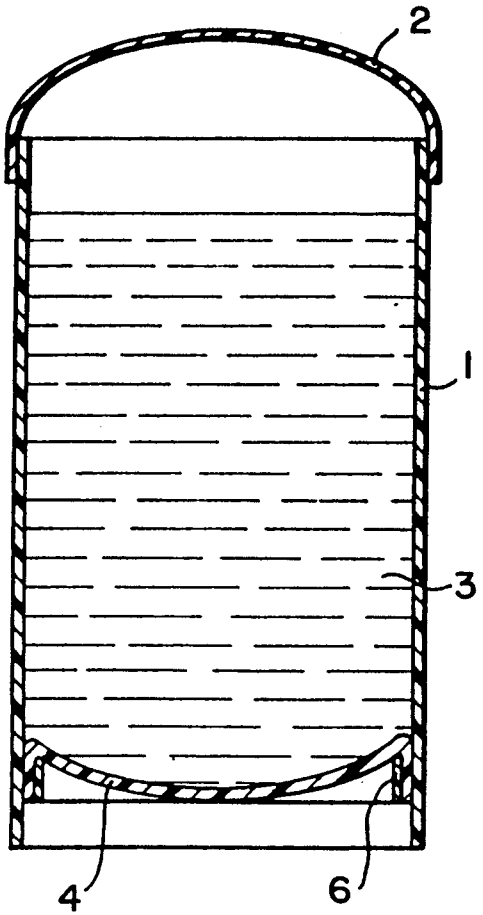
FIG. 3 is a sectional view of a filled package according to still another embodiment of the invention.

In the embodiment shown in FIG. 3, in which the rim of the trough is not turned over, which could lead to a cleavage of the sealed seam, at least one supporting ring is required by which the stress exerted onto the sealed seam is taken up. The supporting ring(s) is/are comprised of a polyvinyl chloride/polyethylene composite material having a thickness of between 0.3 and 3.0 mm and a height of between 5 and 30 mm.

If a film is used as the cover part forming the bottom of the package, the sealed bond is preferably made in such a way that the rim of the cylindrical body projects beyond the bottom, whereby the capability of standing of the package is increased. The supporting ring or rings mentioned above are preferably made of strips of sealable polyvinyl chloride, which preferably are curled or rolled, so that they maintain a generally circular or ring-like configuration.

In the production of the package, care is furthermore taken that at least one of the cover parts and/or the wall of the cylindrically-shaped body is provided with a weakened zone which can be easily opened by exerting pressure and/or piercing, and through which the contents can be removed after opening. It is also possible to provide so-called tear-open tabs.

The invention also provides a process for the production of a filled package. The process is characterized in that first a cylindrically-shaped body is formed of a flexible film, then one cover part is sealed to the cylindrically-shaped body by forming an external and/or internal seam, subsequently the material to be packaged is introduced, and finally the second cover part is bonded to the cylindrically-shaped body by forming an external and/or internal sealed seam.

If composite films including metal layers are to be preferably used, the process is characterized in that the cylindrically-shaped body is produced from a double-faced sealable flat film by first forming an overlapped seam and then shaping the cylindrical body. It is also possible for the individual process steps to be performed in reverse order.

If films are used, the internal sealing is carried out such that at least one of the cover parts is introduced in the folded state and then sealed.

Preference is given to a process in which, prior to the sealing of at least one of the cover parts, at least one supporting ring is inserted from the inside, i.e., at the inner circumference.

Principally, the package is suitable for all materials which set free a gas pressure. It has proved particularly well suited for liquids under gas pressure, preferably carbonated liquids. These include, for example, mineral water, beer, certain types of wine or sparkling wine, and in particular fruit juice based drinks, e.g., soft drinks.

The attached drawing figures show exemplary embodiments of the invention, which are by no sense limiting. The invention will be explained in more detail with reference to the drawings.

Figure 1:
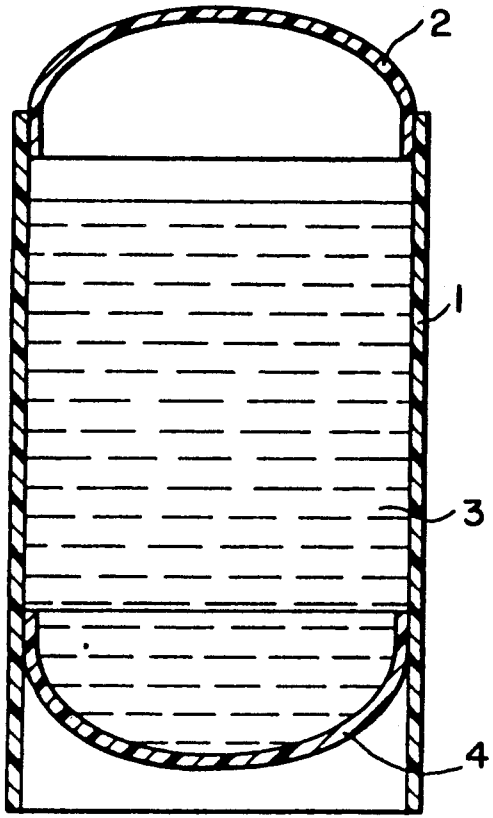
FIG. 1 is a sectional view of a filled package according to the present invention.

FIG. 1 shows a sectional view of a filled package, comprising a cylindrical body 1, cover part 2 (top cover) and the cover part 4 (bottom cover). Cover part 4 is sealed to the cylindrically-shaped body 1 in such a way that the cylindrically-shaped body extends beyond the cover part 4. The reference numeral 3 denotes the contents which are filled into the container.

FIG. 2 shows a sectional view of a filled package with a flat cover part 2 which is sealed to the cylindrically-shaped body from the inside. The cover part 4 is sealed in a turned-over form. Here, too, the reference numeral 3 denotes the contents of the package.

FIG. 3 shows a sectional view of a filled package comprising a cylindrically-shaped body 1, cover part 2 sealed on from the outside and the convex cover part 4 which is sealed on from the inside. The reference number 6 denotes a supporting ring.

Figure 4:
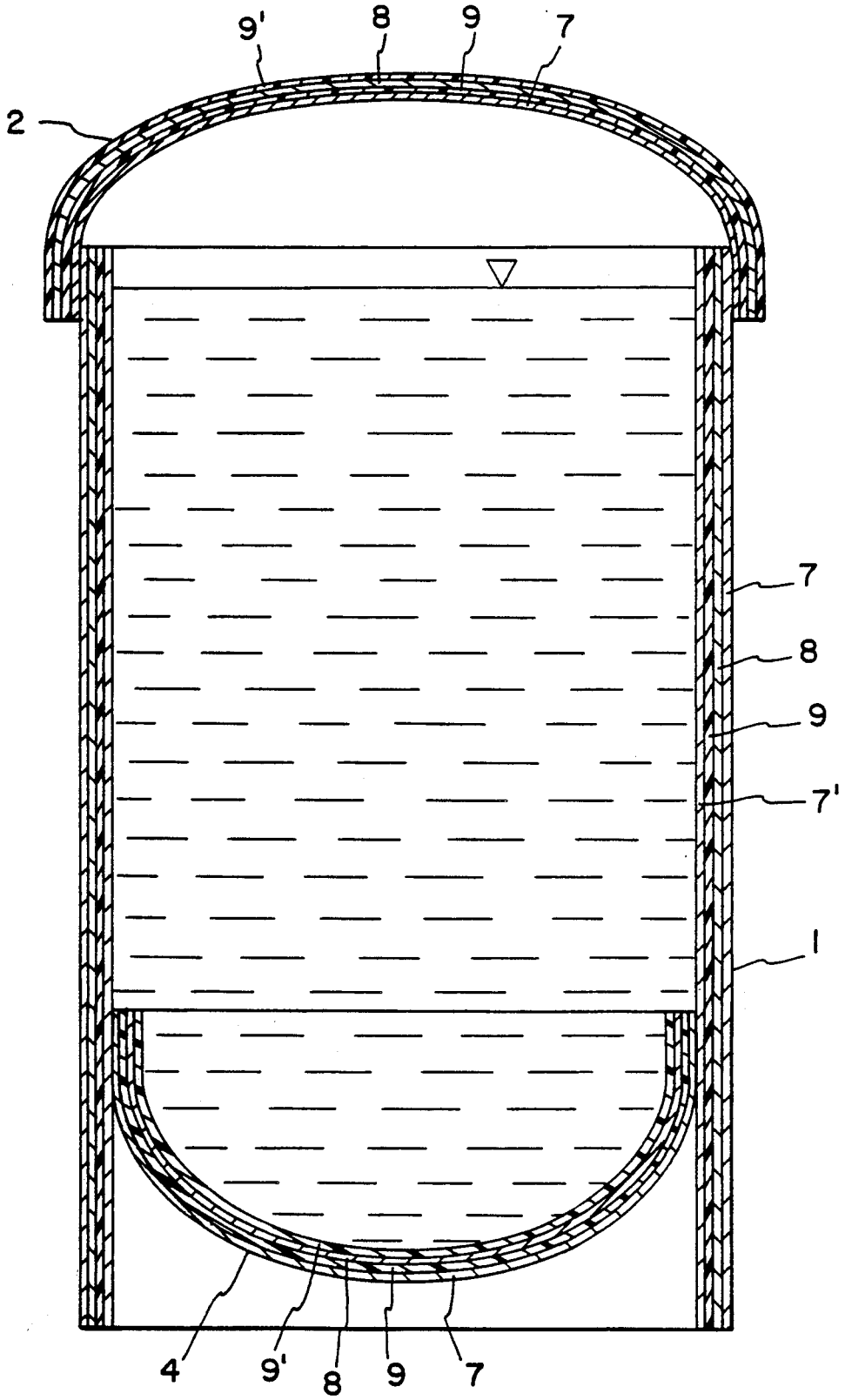

FIG. 4 shows a sectional view of a filled package comprising a cylindrically-shaped body 1 consisting of four layers.

Layer 7 and layer 7' consist of a sealable material, e.g., polyethylene, layer 8 consists of aluminum, and layer 9 consists of polyethylene terephtalate. The cover part 2 is sealed on the cylindrically-shaped body from the outside and also consists of four layers. Layer 7 also consists of a sealable material, e.g., polyethylene, layers 9 and 9' consist of polyethylene terephthalate and layer 8 consists of aluminum. The cover part 4 is sealed on the cylindrically-shaped body from the inside and also consists of four layers. Layer 7 consists of a sealable material, e.g., polyethylene, layers 9 and 9' consist of poylethylene terephthalate, and layer 8 consists of aluminum.

In the most preferred embodiment of the invention, the cylindrically-shaped body 1 consists of a flexible film having a thickness of 50 to 800 μm and consisting of at least four layers. The cover part 2 also consists of a flexible film having a thickness of 50 to 800 μm and also consisting of at least four layers. If the cover part 2 is injection-molded, it has a thickness of at least 500 μm. The cover part 4 consists of a flexible film having a thickness of 50 to 800 μm and also comprising four layers.

The container is intended to be filled with liquids under internal pressure, in amounts of 0.1 to 1 liter.

Sealing is preferably effected by means of heat-sealing, but sealing with supersonic is also possible.

What is claimed is:

1. A flexible package which can be pressurized and is suitable for internally pressurized products to be packaged, and which is capable of standing by itself, comprising:

a generally cylindricaly-shaped body, comprised of a flexible film comprising at least one plastic surface;

a first cover part comprised of a flexible film comprising at least one plastic surface at one end of said cylindrically-shaped body; and a second cover part comprised of a flexible film comprising at least one plastic surface at the opposite end of said cylindrically-shaped body;

a seam structure for melt sealing said first and second cover parts to said plastic surface of said flexible film of said body and for preventing cleavage of said cover parts from said body wherein said seam structure comprises a bonding seam between each of said cover parts and said body, said seam being oriented such that internal pressure exerted by products packaged in the package causes parting forces at said seam primarily in a direction generally parallel to the surfaces of each of said cover parts and said body rather than normal to said surfaces, whereby cleavage of said seam is prevented;

wherein said first and said second cover parts both comprise a generally convex-concave shape having free edges defining an opening in said shape, said opening extending toward said cylindrically-shaped body and said free edges extending in a direction away from said convex-concave shape and lying generally parallel to said cylindrically-shaped body in an annular region, wherein said seam structure is located in said annular region and wherein said body and said first and second cover parts each comprise a multilayer film including at least one gas barrier layer, wherein said first cover part is a first-applied cover and said second cover part is a second-applied cover part applied to said body after said first cover part to close the package, and wherein said second cover part has a heat sealable outer layer on only its surface facing away from the inside of the package, and whereby the package is capable of standing by itself and, when empty, can be easily compressed by hand.

2. A flexible package as claimed in claim 1, wherein said cylindrically-shaped body comprises a multiple layer film including a gas barrier inner layer and two surface layers of melt sealable plastic.

3. A flexible package as claimed in claim 2, wherein said gas barrier layer comprises a metal layer.

4. A flexible package as claimed in claim 3, wherein said metal layer comprises an aluminum foil.

5. A flexible package as claimed in claim 2, wherein said multiple layer film comprises an additional intermediate layer comprising polyethylene terephthalate.

6. A flexible package as claimed in claim 1, wherein at least one of said first and said second cover parts comprises a multiple layer film including a gas barrier layer and two surface layers.

7. A flexible package as claimed in claim 6, wherein said gas barrier layer comprises a metal layer.

8. A flexible package as claimed in claim 7, wherein said metal layer comprises an aluminum foil.

9. A flexible package as claimed in claim 6, wherein at least one of said two surface layers of said cover part is comprised of a melt sealable layer.

10. A flexible package as claimed in claim 6, wherein said multiple layer film comprises an additional intermediate layer comprising polyethylene terephthalate.

11. A flexible package as claimed in claim 6, wherein said second cover part is sealed to said cylindrically-shaped body on its inner cylindrical surface.

12. A flexible package as claimed in claim 1, wherein said first cover part is sealed to the rim of said cylindrically-shaped body from the outside, in a way such that it surrounds said rim of cylindrically-shaped body.

13. A flexible package as claimed in claim 12, wherein said first cover part closes cylindrically-shaped body at the upper end and said second cover part closes said cylindrically-shaped body at the lower end.

14. A flexible package as claimed in claim 1, wherein the first cover part is sealed to the rim of cylindrically-shaped body from the inside.

15. A packaged product, comprising a flexible package as claimed in claim 1, and a liquid product under gas pressure contained within the package.

16. A packaged product as claimed in claim 15, wherein said product under gas pressure comprises a carbonated liquid.

17. A method for the production of a filled package which can be pressurized and is suitable for internally pressurized products to be packaged, and which is capable of standing by itself, comprising a generally cylindrically-shaped body, comprised of a flexible film comprising at least one plastic surface; a first cover part comprised of a flexible film comprising at least one plastic surface at one end of said cylindrically-shaped body; and a second cover part comprised of a flexible film comprising at least one plastic surface at the opposite end of said cylindrically-shaped body; a seam structure for melt sealing said first and second cover parts to said plastic surface of said flexible film of said body and for preventing cleavage of said cover parts from said body wherein said seam structure comprises a bonding seam between each of said cover parts and said body, said seam being oriented such that internal pressure exerted by products packaged in the package causes parting forces at said seam primarily in a direction generally parallel to the surfaces of each of said cover parts and said body rather than normal to said surfaces, whereby cleavage of said seam is prevented; wherein said first and said second cover parts both comprise a generally convex-concave shape having free edges defining an opening in said shape, said opening extending toward said cylindrically-shaped body and said free edges extending in a direction away from said convex-concave shape and lying generally parallel to said cylindrically-shaped body in an annular region, wherein said seam structure is located in said annular region and wherein said body and said first and second cover parts each comprise a multilayer film including at least one gas barrier layer, wherein said first cover part is a first-applied cover part and said second cover part is a second-applied cover part applied to said body after said first cover part to close the package, and wherein said second cover part has a heat sealable outer layer on only its surface facing away from the inside of the package, and whereby the package is capable of standing by itself and, when empty, can be easily compressed by hand, comprising the steps of:

first forming said cylindrically-shaped body of said flexible film;

sealing said first cover part to a first end of said cylindrically-shaped body by forming an external or internal seam, to form an open container open at a second end of said cylindrically-shaped body;

subsequently filling a material to be packaged into said open container; and finally sealing said second cover part to said cylindrically-shaped body on its inside circumference, said second cover part comprising said heat sealable outer layer on only its surface facing away from the inside of said container.

18. A method as claimed in claim 17, wherrein said step of sealing said second cover part comprises arranging said generally convex-concave shaped second cover part having its free edges lying generally parallel to the plastic film of said cylindrically-shaped body in an annular region at said second end, inverting the convex-concave shape by moving its center into said container to form said second cover part into the shape of an inverted trough having double walls formed by a double thickness of the film at the free edges of said second cover part, and melt sealing the outer surface of the free edges of said second cover part to the inside surface of said cylindrically-shaped body, over the entire circumference.

19. A method as claimed in claim 17, wherein said cylindrically-shaped body is produced of a flat film having two melt-sealable surface layers, by first forming an overlapped seam and then sealing the overlapped edges to form said cylindrically-shaped body.

* * * * *